US005079557A

United States Patent [19]

Hopwood et al.

[11] Patent Number: 5,079,557

[45] Date of Patent: Jan. 7, 1992

[54] PHASED ARRAY ANTENNA ARCHITECTURE AND RELATED METHOD

[75] Inventors: Francis W. Hopwood, Severna Park; Peggy J. Sowell, Marriottsville, both of Md.

[73] Assignee: Westinghouse Electric Corp., Pittsburgh, Pa.

[21] Appl. No.: 632,784

[22] Filed: Dec. 24, 1990

[51] Int. Cl.[5] ..... H01Q 3/22; H01Q 3/24; H01Q 3/26

[52] U.S. Cl. ..... 342/373; 342/372

[58] Field of Search ..... 342/373, 372, 368

[56] References Cited

U.S. PATENT DOCUMENTS 4,827,270 5/1989 Udagawa et al. ..... 342/373

*Primary Examiner*—Theodore M. Blum
*Attorney, Agent, or Firm*—W. G. Sutcliff

[57] ABSTRACT

A phased array antenna having a first plurality of phase shifters each connected to a solid state transmit module power amplifier. Equal split power combiners, each having a pair of inputs and a pair of outputs, are connected to the power amplifiers and to each other in a corporated tree hierarchal configuration. One of the pair of inputs of each of the power combiners of each higher hierarchy is connected to one of the pair of outputs of the power combiners of a lower hierarchy. A subarray is connected to the other of the pair of outputs of each of the power combiners. A subarray is connected to both outputs of the highest hierarchy. A second plurality of individual phase shifter elements are associated with the individual elements of each subarray. The first plurality of phase shifter elements adjust the illumination and phase of the signal entering each subarray. The second plurality of phase shift elements steer the beam. The array architecture enables varying the aperture taper without incurring significant power loss; and the internal tapering of each subarray to control quantization effects.

13 Claims, 5 Drawing Sheets

PHASED ARRAY ANTENNA ARCHITECTURE AND RELATED METHOD

BACKGROUND OF THE INVENTION

1. Field of the Invention

The present invention relates to a phased array antenna and related method; and more particularly, to the architecture and related method of a phased array antenna for controlling the aperture illumination of a radiated beam.

2. Discussion of Related Art

Phased array antennae may be classified as either being an active array antenna or a passive array antenna. Passive arrays typically do not provide selectable weighting since the weighting of the aperture is established by the mechanical dimensions and the characteristics of the manifolds upon manufacture. Typically, the manifold of a passive array routes the appropriate microwave power to the individual phase shifters and radiators with very little loss. Routing the correct power at the appropriate phase to the radiator determines the aperture weighting.

Active arrays are being proposed with selectable weighting of the apertures, but in a manner which results in very significant performance penalties. For example, most or all of the elements are sized to generate the same RF power via local dedicated power amplifiers. Although this arrangement is efficient and cost effective with respect to the manufacture of the amplifiers, it is most advantageous for arrays where the apertures are uniformly illuminated or arrays with uniform illumination in the center of the array and less power around the periphery, such as trapezoidal or step tapers, for example. Conventional active antenna arrays that utilize low sidelobe weighting, such as 45 dB Taylor weight, results in significant performance degradation because much of the power is attenuated or lost, rather than being redistributed, as is the case of the passive antenna array. For example, attenuating from a uniform weighting to a heavy Taylor weighting results in a 6 dB power loss in addition to the inevitable taper loss of about 1.5 dB. The six dB power loss represents a significant degradation in radar range performance and is a serious shortcoming of the active array concept.

SUMMARY OF THE INVENTION

One of the objects of the present invention is to provide architecture for a phased array antenna and its associated solid state microwave power source, which permits aperture weighting and beam shape to be varied in response to the immediate needs of the system in which the antenna is utilized.

Another object of the present invention is to provide a phased array antenna architecture having the ability to select, control, or program aperture illumination or taper, with arbitrary amplitude and phase functions, without incurring significant power loss.

A further object of the present invention is to provide a phased array antenna architecture having the ability to pattern null steering which requires both amplitude and phase control.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the objects and in accordance with the purpose of the invention as embodied and broadly described herein, the phased array antenna of the present invention comprises a common microwave power source; a first plurality of individual phase shifter elements, each having an input and an output, the input of each phase shifter element being connected in parallel to the common power source; a plurality of power amplifiers, each having an input and output, the input of each power amplifier being connected to the output of a respective one of the plurality of phase shifter elements for adjusting the taper, power and phase of a signal entering a plurality of power combiners; a plurality of equal split power combiners each having a first and a second input and a first and a second output, the plurality of power combiners being coupled to the plurality of power amplifiers and to each other in a hierarchal corporate tree configuration wherein each one of the first and second inputs of the lowest hierarchy of power combiners is connected to a respective output of the plurality of power amplifiers, each one of the first and second inputs of each higher hierarchy of the power combiners being connected to the first output of a respective power combiner of a lower hierarchy of the plurality of power combiners; a plurality of subarrays, each connected to the second output of the plurality of power combiners, a plurality of antenna radiator elements for each subarray; and a second plurality of phase shifter elements, each connected to a radiator element of a respective subarray for controlling the phase of the signal entering the individual radiator element to steer the beam, the first plurality of phase shifter elements for controlling the phase of the signals entering corresponding power combiners of the hierarchal corporate tree to adjust the taper, power, and phase of the signals entering respective subarrays.

In another aspect of the present invention as embodied and broadly described herein, the method of the present invention of weighting and shaping the beam of a phased array antenna comprises coupling a first plurality of phase shifter elements in parallel to a common microwave power source; coupling an input of a plurality of transmit power amplifiers to an output of each phase shifter element; providing a plurality of equal split power combiners, each having a first and a second input and a first and a second output; coupling the plurality of power combiners to the plurality of power amplifiers and to each other in a hierarchal corporate tree configuration, including coupling each of the first and the second inputs of the lowest hierarchy of the plurality of power combiners to the output of a respective power amplifier; coupling each of the first and second inputs of each higher hierarchy of the plurality of power combiners to a respective first output of a lower hierarchy of the plurality of power combiners; coupling the second output of each of the plurality of power combiners to a subarray of individual antenna radiating elements; providing a second plurality of phase shifter elements for respective individual radiating element of each coupled subarray of elements; varying the phase of selected ones of the first plurality of phase shifter elements for selecting the power and phase of the microwave signal entering corresponding ones of the plurality of the power combiners and a respective subarray; varying the phase of selected ones of the second plurality of phase shifter element for controlling the phase of the microwave signal of each of the individual elements of a corresponding subarray.

The accompanying drawings, which are incorporated in an constitute a part of this specification, illustrate one embodiment of the invention and together with the description, serve to explain the principles of the invention.

DESCRIPTION OF THE PREFERRED

Figure 1:
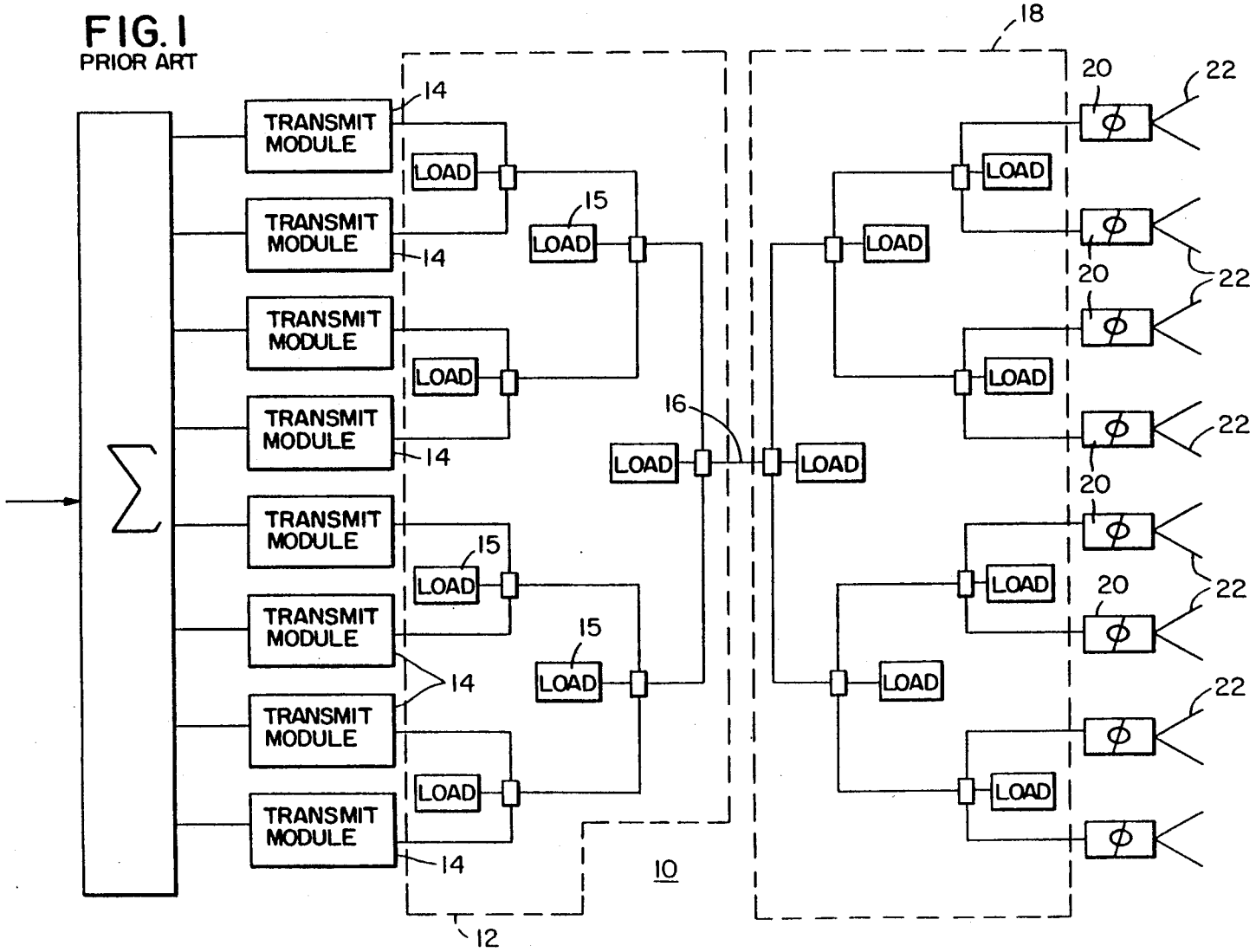
FIG. 1 PRIOR ART
FIG. 1 is a schematic diagram of a conventional phased array antenna with solid state transmit modules.

A conventional antenna array with a solid state transmitter, which tends to suffer performance degradation because of power attenuation is schematically illustrated in FIG. 1 and referred to by reference numeral 10. System 10 includes a solid state transmitter combined into a uniform corporate transmit manifold, referred to within dashed lines 12, and includes a multiplicity of transmit modules 14 which are sometimes referred to as power amplifiers, and loads 15. Typically, microwave energy is combined into a common wave guide and fed over a line 16 to a passive array antenna illustrated within dashed line 18. As shown in FIG. 1, two complete manifolds 12 and 18 are required for such an antenna array. Manifold 12 combines the outputs of individual transmit modules or power amplifiers 14, while manifold 18 distributes the microwave energy to individual phase shifters 20 and their corresponding radiators 22. Manifold 18 permanently establishes the aperture illumination of the antenna array upon manufacture.

Figure 2:
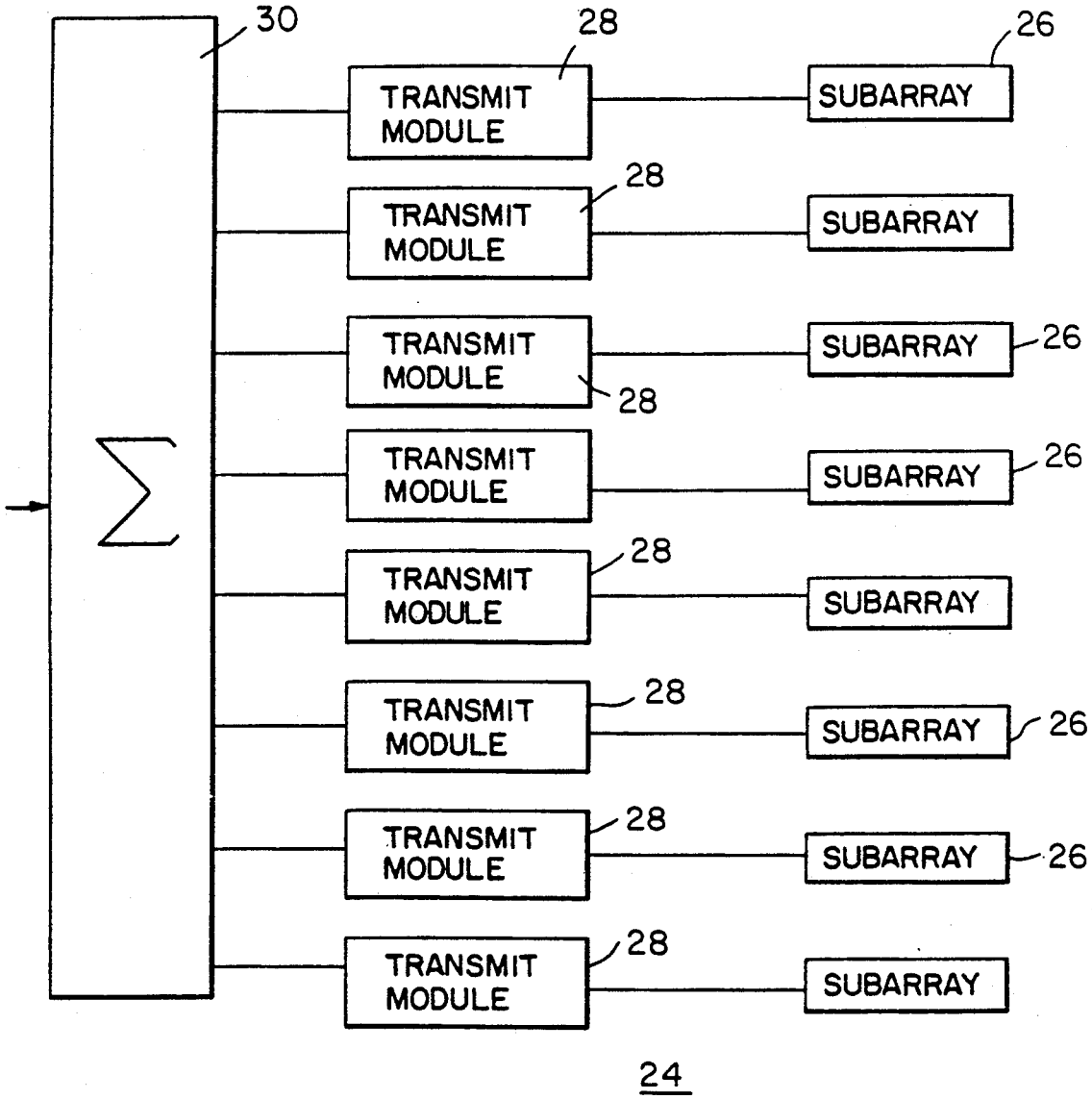
FIG.2 PRIOR ART
FIG. 2 is a schematic diagram of another form of conventional phased array antenna with dedicated subarrays.

With reference to another conventional system referred to by reference numeral 24 of FIG. 2, small groups of radiating elements of the antenna called subarrays, and referred to at 26, are connected to individual transmit power modules 28. Conventional system 24, in a manner similar to system 10, splits the microwave power from manifold 30 to the individual transmit module amplifiers 28, which in turn feed subarrays 26 of individual antenna elements. Although this is a simple configuration of a solid state aperture, it suffers the same performance degradations as the array of FIG. 1, when low sidelobe weightings are required. Also, its performance degrades significantly in the event of failure of a transmit module 25, since that results in a loss of transmit power to an entire subarray, which is an appreciable portion of the aperture.

Reference will now be made in detail to the present preferred embodiment of the invention, an example of which is illustrated in the accompanying drawings.

Figure 3:
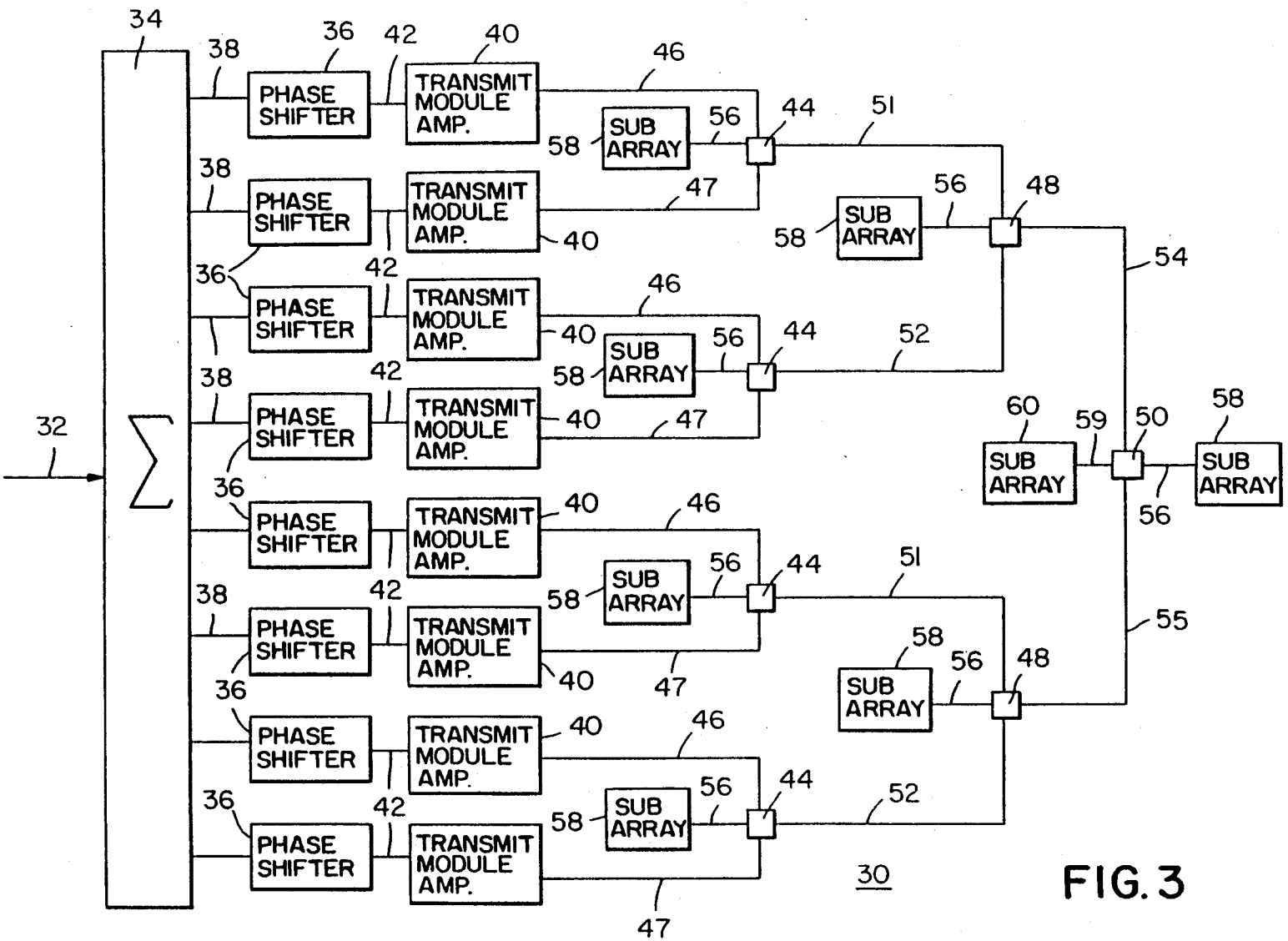
FIG. 3 is a schematic block diagram of a solid state antenna array in accordance with an embodiment of the present invention.

The present invention is a solid state phased array antenna activated by a common microwave power source. As herein embodied and referring to FIG. 3, antenna 30 has a microwave power source, represented by line 32 which supplies microwave energy to a manifold 34 which receives and distributes the input power to the array.

In accordance with the invention, the phased array antenna includes a first plurality of phase shifter elements, each having an input and an output, with the input of each phase shifter element being connected to the power source. As embodied herein, each phase shifter elements 36 has an input 38 connected in parallel to manifold 34. Phase shifter elements 36 may be of any well known type and are each individually controllable over lines 37 by well known computer control apparatus or programmable controllers. The array of the present invention also includes a plurality of transmit module power amplifiers each having an input and an output; the input of each transmit module power amplifier is connected to the output of a respective phase shifter element for controlling the taper, power, and phase of a signal entering respective power combiners. As herein embodied and referring to FIG. 3, transmit module power amplifiers 40 each have an input connected to output 42 of a respective phase shifter 36.

In accordance with the present invention, a plurality of equal-split-power combiners, each having a first and a second input and a first and a second output are coupled to the plurality of transmit module power amplifiers and to each other in a corporate tree configuration having a plurality of hierarchies wherein each one of the first and second inputs of each of the lowest hierarchy of the plurality of power combiners is connected to the output of a respective transmit module power amplifier. Each one of the first and second inputs of each higher hierarchy is connected to the first output of a respective power combiner of a lower hierarchy of the plurality of power combiners.

As herein embodied, a plurality of conventional equal-splitpower combiners are connected in a hierarchal corporate tree configuration where the lowest hierarchy of the plurality of power combiners includes power combiners 44. Each power combiner 44 has a pair of inputs 46 and 47 that are respectively connected to an output of a corresponding pair of transmit module power amplifiers 40. Power combiners of the next higher hierarchy are referred to herein by reference numeral 48; and a power combiner of a still higher hierarchy is referred to as 50 in FIG. 3. Each power combiner 48 has inputs 51 and 52 connected to one output of each of two of the lower hierarchy of power combiners 44. Power combiner 50 has inputs 54 and 55 each respectively connected to one of the outputs of each of two of the lower hierarchy of power combiners 48. Each higher hierarchy of power combiners has one half the number of power combiners as the next lower hierarchy.

For the sake of simplicity, only three hierarchies of power combiners are shown and described herein. However, it is understood that in actual practice, there can be many more hierarchies of power combiners depending on the number of individual transmit module power amplifiers in the array. The power combiners may be of any well known type where the power from a pair of amplifiers is combined and split in the lowest hierarchy, of power combiners 44 and subsequently the power from a pair of power combiners in each lower hierarchy to each power combiner of each higher hierarchy is combined and equally split.

In accordance with the invention, a plurality of subarrays is provided with a subarray being connected to a respective one of the second outputs of the plurality of power combiners and to a respective one of the first outputs of the highest hierarchy of the plurality of power combiners. As embodied herein, each of the power combiners 44, 48, 50 has an output 56 connected to a respective one of a plurality of subarrays 58, and power combiner 50 has a subarray 60 connected to output 59 thereof.

The present invention includes a plurality of radiating elements in each subarray of the antenna array; and a second plurality of phase shifter elements operatively connected to a respective radiator element for steering the beam. As herein embodied, and referring to FIG. 4 each subarray 58 and subarray 60 includes a plurality of radiator elements 62 having a phase shifter element 64. Each phase shifter element 64 receives the phase shifter RF signal in common from manifold 61 and is further controlled in a conventional manner over line 65 by well known computer driven controllers in the same manner as elements 36.

A more detailed description of the antenna architecture and the method of weighting and shaping the beam of the phased array antenna of the present invention is provided in connection with a description of its operation. Referring again to FIG. 3, low level microwave power from a conventional signal source 32 enters the array at manifold 34 where it is split into a multiplicity of paths on phase shifter inputs 38. Each path 38 contains a phase shifter element 36 and a transmit module power amplifier 40. Each power amplifier 40 is fully saturated at a common output and coupled to one of the inputs 46 and 47 of power combiners 44 of the lowest hierarchy. Each pair of transmit module amplifiers 40 feeds an equal split power combiner 44, with each pair of power combiners 44 in turn feeding another power combiner 48. A pair of power combiners 48 feed a power combiner 50, thus forming a corporate tree.

Figure 4:
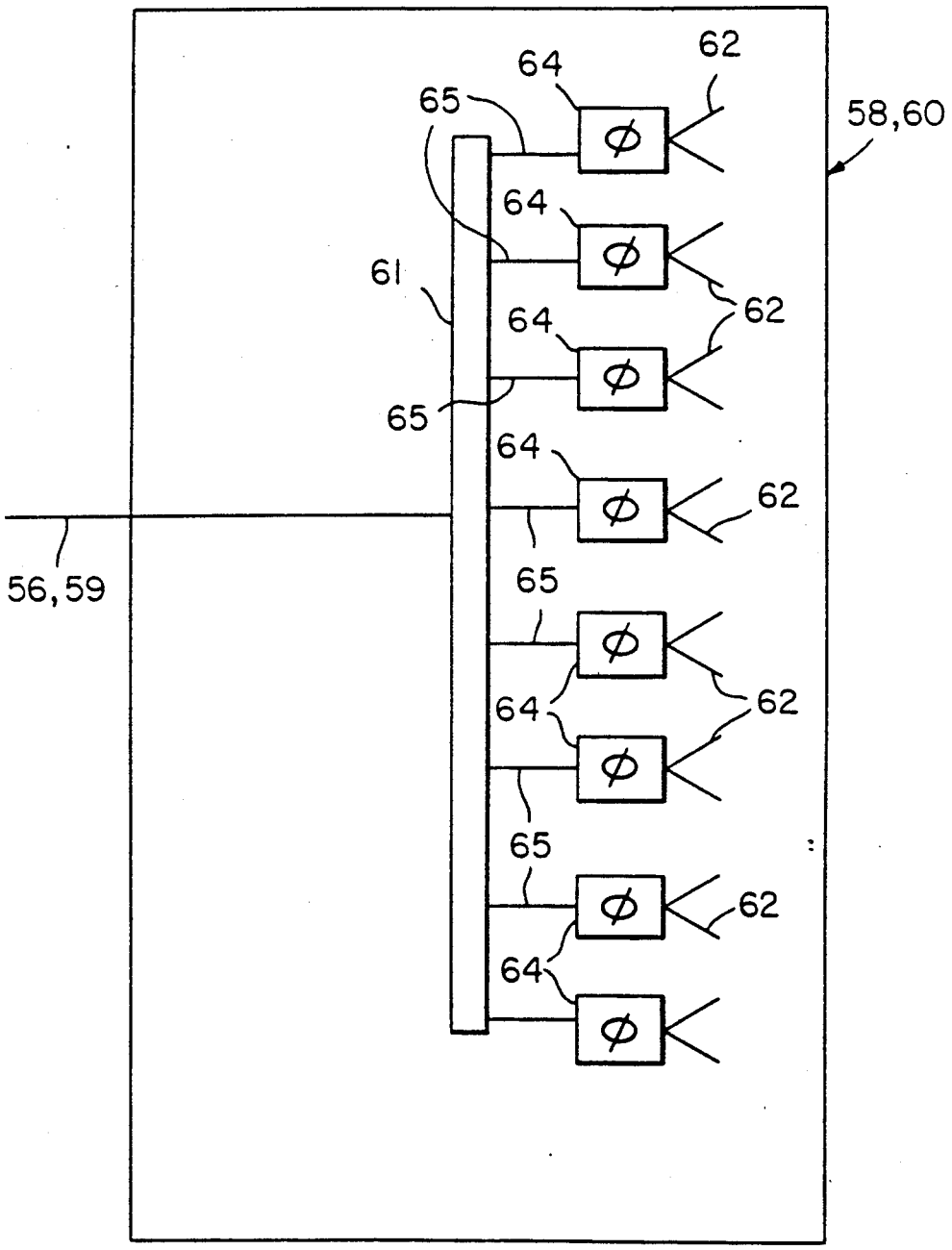
FIG. 4 is a schematic block diagram of one of the subarrays of the antenna of FIG. 3 of the present invention.

It should be noted that output 56 of each of the plurality of power combiners 44, 48 and 50 is connected to an individual subarray 58. In addition, the highest hierarchy power combiner 50 is connected by output 59 to subarray 60. This connection is in contrast to the prior art array such as that shown in FIG. 1 where terminating loads such as 15 are normally connected to one of the outputs of each power combiner in the corporate tree. With subarrays 58 being connected in accordance with the present invention, provides an advantage of permitting the aperture illumination to be adjusted as desired. To establish the illumination, the phase of the signal ultimately entering each subarray 58, 60 is adjusted by varying a corresponding one of the first plurality of phase shifter elements 36 by a computer or programmable controller over line 38. This influences the vector sum of the signals entering each of the subarrays. Further phase rotation is then provided within each subarray 58, 60 by varying the phase of the beam steering or second phase shifters 64 as shown in FIG. 4.

With the present invention, if uniform illumination of the radiators is desired, phase shifters 36 are adjusted until the power and phase in all subarrays 58, 60 are equal. For a heavy weighting of the individual elements, phase shifters 36 are adjusted so that the subarrays connected to power combiners 44, herein referred to as the lowest hierarchy power combiners, nearest the transmit module power amplifiers 40 receive relatively little power; while the subarrays 58, 60 connected to higher hierarchy power combiners 48 and 50, respectively, which are farther from transmit modules 40 receive the most power. In a two dimensional array configuration, subarrays 58 which are connected to the lowest hierarchy of power combiners 44, which are connected directly to transmit module power amplifiers 40, are preferably located around the periphery of the antenna array, while the subarrays 58 connected to the higher hierarchy, such as power combiners 48, and subarray 60 connected to power combiner 50 are located at the center of the array.

If the subarrays 58, 60 were uniformly illuminated internally; that is, each individual radiator 62 of a subarray has the same power and phase, the array spatial sidelobes would be degraded due to quantization effects. In accordance with the present invention, this is overcome by selecting a representative heavy weighting, and adjusting each subarray internal taper to perfectly match the spatial sidelobes. Thus, when such heavy or similar weighting is selected, there is no performance degradation due to quantization of the spatial lobes. Instead, quantization effects will appear when little or no weighting is used, and when low spatial sidelobes are not anticipated. By being able to adjust the phase of the signal entering each subarray 58,60, together with the ability of further adjusting the signal of each individual radiator 62, (FIG. 4) pattern null steering, which requires both amplitude and phase control, can be effected. Similarly, certain variations of multiple beam formation may be possible through the use of the many separate amplitude and phase controls.

Figure 5:
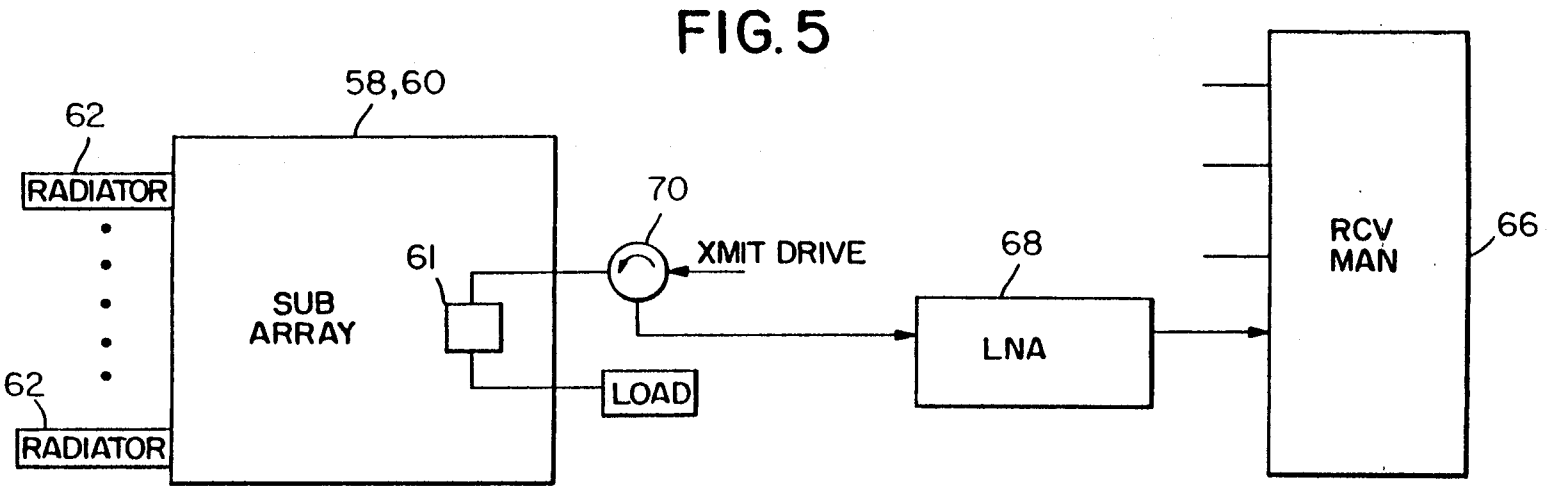
FIG. 5 is a partial schematic block diagram illustrating one form of a receive function that may be utilized with the antenna architecture of the present invention.

Referring to FIG. 5, the receive function of the array may be effected by connecting each of the subarrays 58,60 to a receive manifold 66, either directly or through low noise amplifiers 68. Low noise amplifiers 68 are preferably connected through a circulator 70 to manifold 61 of the subarray.

Figure 6:
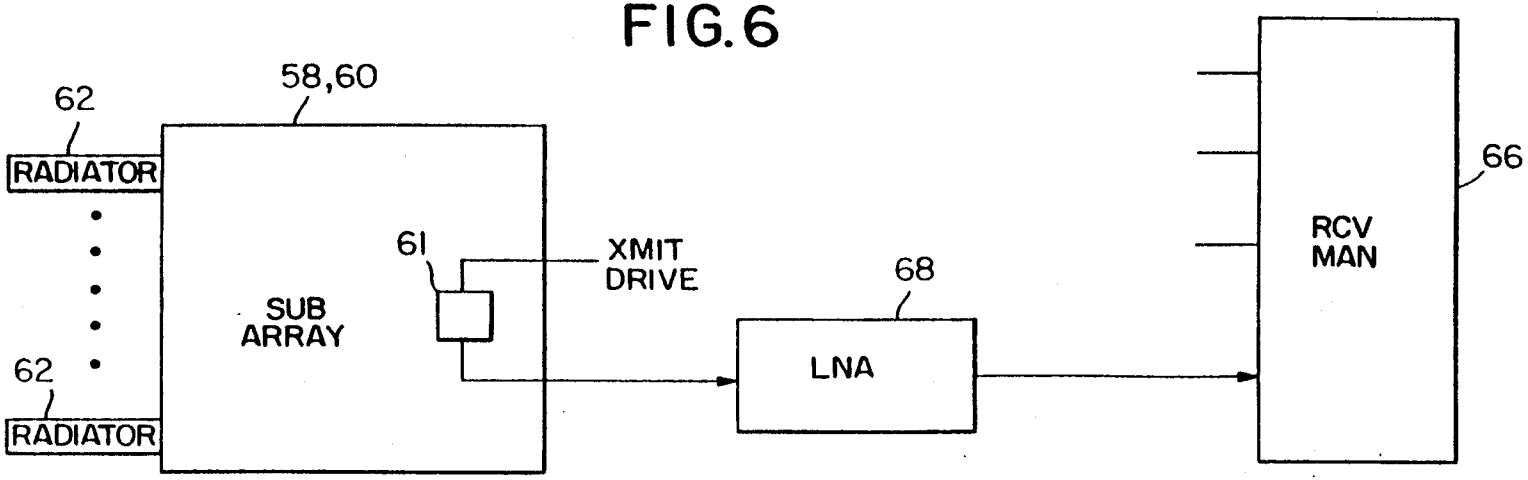
FIG. 6 is a partial schematic block diagram of another embodiment of a receive function that may be utilized with the array antenna architecture of the present invention.

In the alternative, and referring to FIG. 6 the receive manifold 66 may be directly connected via low noise amplifier 68 directly to subarray manifold 61, if the subarray phase shifters 64 (FIG. 4) can be reset between the transmit and receive functions of the array. For such an application, a high speed phase shifter 64 is required.

Phase control for beam forming and pointing can be readily accomplished with the present invention. The beam pointing expression for phase at any array radiator element located at row i, column j is computed from the pointing roots as follows:

$$\rho i = 2\pi/\lambda\ \Delta i \sin\alpha i \quad (1)$$

$$\rho j = 2\pi/\lambda\ \Delta j \sin\alpha j \quad (2)$$

$$\phi ij = i\rho i + j\rho j \quad (3)$$

where $\rho i$, $\rho j$ are the respective row and column pointing roots $\Delta i$, $\Delta j$ are the respective row and column element-to-element spacing and $\alpha i$, $\alpha j$ are the respective row and column angles to the desired pointing direction To extend this well known method to the architecture of the array of the present invention, subarrays 58 combine in phase to form a continuous phase front; and the phase contribution of each phase shifter 36 of the transmit module must be known. The phase front from the subarrays 58, 60 will combine continuously, if each subarray contributes a net phase of zero. If the phase center is located at the center of each subarray, the net phase will be zero. If the phase is computed from a corner of the subarray, the following method can be used to offset the phase center to the subarray center:

$$\phi c = \left(\frac{n\rho i + 1}{2}\right) + \left(\frac{m\rho j + 1}{2}\right) \quad (4)$$

where n=number of rows m=number of columns

The phase commanded to the transmit module phase shifter 36, $\phi k$, is known from the desired amplitude weighting distribution.

The beam pointing expression for the disclosed architecture can be expressed as follows, combining equations 3 and 4:

$$\phi ijk = \phi ij - \phi c - \phi k \quad (5)$$

where k=subarray/transmit module number

The computation of the expression can be reduced to practice through a combination of central and/or distributed processing.

For example, the computation of the pointing roots, $\rho i$ and $\rho j$, and the phase center, $\phi c$, can be accomplished in a central processor with floating point arithmetic and a simple expansion or table look-up for the sine function. These values are common to each phase shifter element, such as 64.

Continuing the example, the personalization of the roots to each phase shifter element 64 can be accomplished in distributed software processing or in dedicated hardware. Since the phase center term and the transmit module phase offset are common to all phase shifter elements 64 in a subarray, the required operations per phase shifter element 64 are reduced to two multiplications and two additions. Including data storage, a throughput of 250 KOPS (thousand operations per second) would support a 16-element subarray at a 2 KHz rate. Since fixed-point arithmetic is sufficient, either well known hardware or software could be applied.

These considerations show that phase control for beam forming and pointing are readily accomplished with the system and method of the present invention.

The array of the present invention is capable of supporting a wide variety of array orientations and shapes and grid geometries. For example, for use in air-air or air-ground applications, an antenna array may be composed of 128 subarrays grouped as 16 element parallelograms with a total of 2048 individual element locations. In practice, a few of these could be used as mechanical supports. The relevant parameters of this embodiment are summarized in the following table.

Number of Radiators: 2048
Number of Transmit Modules: 128
Transmit Module Peak Power: 40 Watts
Peak Radiated Power: 5000 Watts
Number of Sub-arrays: 128
Number of Elements per Sub-array: 16
Number of LNA's: 128
Weight Choices: Uniform 45 dB Taylor Trapezoidal While the array of the present invention is primarily intended for high performance airborne radar, it is also applicable to other types of systems. In the radar application, the array of the present invention can be optimized by a particular radar mode and specific scenario. For example, in a high altitude long range search application, the antenna spatial sidelobe characteristics may not be of great importance. While taper loss associated with heavy aperture weighting presents an important loss in system sensitivity it may be desirable to use a uniform aperture weighting. In other radar modes, the antenna spatial sidelobes are of significant importance while the taper loss associated with low sidelobe aperture weighting may be acceptable. In those applications, it may be desirable to use a low sidelobe aperture weighting such as a Taylor weight.

It will be apparent to those skilled in the art that various modifications and variations can be made in the antenna and architecture and in the methods of the present invention without departing from the scope and spirit of the invention. Thus, it is intended that the present invention cover such modifications and variations, provided they come within the scope of the appended claims and their equivalents.

We claim:

1. A method of weighting and shaping the beam of a phased array antenna comprising coupling a first plurality of phase shifter elements in parallel to a common microwave power source;

coupling an input of a plurality of transmit module power amplifiers to an output of each phase shifter element;

providing a plurality of equal split power combiners, each having a first and a second input and a first and a second output;

coupling the plurality of power combiners to the power amplifiers and to each other in a hierarchal corporate tree configuration, including:

coupling each of the first and second inputs of a lowest hierarchy of the plurality of power combiners to the output of respective power amplifier;

coupling each of the first and second inputs of each higher hierarchy of the plurality of a power combiners to a respective first output of a lower hierarchy of power combiners;

coupling the second output of each of the plurality of power combiners to a respective subarray of individual antenna radiating elements;

providing each of a second plurality of phase shifter elements for each individual radiating element of each coupled subarray of elements; and varying the phase of selected ones of the first plurality of phase shifter elements for selecting the power and phase of a microwave signal entering corresponding ones of the plurality of power combiners and a respective subarray; and varying the phase of selected ones of the second plurality of phase shifter elements for controlling the phase of the microwave signal of each of the individual elements of a corresponding subarray.

2. The method of claim 1 further comprising the steps of saturating fully each transmit module power amplifier at a common output.

3. The method of claim 1 further comprising equalizing the power and phase of the microwave signal entering each subarray from a corresponding power combiner to provide uniform illumination.

4. The method of claim 1 wherein the step of varying the phase of the first phase shifter elements includes:

varying the phase of the signal entering a corresponding subarray from the plurality of power combiners having inputs directly connected to output of power amplifiers of the transmit modules for decreasing the power to the subarrays connected to the corresponding power combiners, and varying the phase of the power combiners connected farthest from the power amplifiers to increase the power of the microwave signal entering the corresponding subarrays.

5. The method of claim 1 wherein the step of varying the phase of selected ones of the first and second plurality of phase shifter elements includes:

equalizing the phase of each of the microwave signals entering the subarrays, and varying the phase of selected ones of second phase shifter elements to match a spatial sidelobes of the signal entering the respective subarray.

6. The method of claim 1 wherein the step of varying the signal entering each of the plurality of subarrays includes combining in phase to form a continuous phase front of the antenna array, and varying the phase in each of the individual radiating elements in accordance with the location of the elements in the array and the phase change of the corresponding microwave signal entering a respective subarray.

7. The method of claim 6 wherein the provision of a continuous phase front includes locating the phase center at the center of each subarray to provide a net phase of zero.

8. The method of claim 6 wherein the provision of a continuous phase front includes locating the phase center from a selected corner of each subarray and offsetting the phase center to the subarray according to the following calculation:

$$\phi c = \left(\frac{n\rho i + 1}{2}\right) = \left(\frac{m\rho j + 1}{2}\right)$$

where $\phi c$ is phase center, n is the number of rows, $\rho i$ is the location of the row pointing root, m is the number of columns, $\rho j$ is the location of the column pointing root; and determining each phase of the first plurality of phase shifter elements for a selected amplitude weighting distribution, in accordance with the following calculation:

$$\phi ijk = \phi ij - \phi c - \phi k$$

where k = transmit module number of the subarray

9. The method of claim 5 wherein the step of varying the phase includes selectively weighting the internal illumination of each subarray to match the spatial sidelobes for controlling effects of quantization.

10. A phased array antenna, comprising a common microwave power source;

a first plurality of individual phase shifter elements, each having an input and an output, the input of each phase shifter element being connected in parallel to the common power source;

a plurality of power amplifiers each having an input and output, the input of each power amplifier being connected to the output of a respective one of the plurality of phase shifter elements for adjusting the taper, power and phase of the signal entering each of a plurality of power combiners;

a plurality of equal split power combiners each having a first and second input and first and second output, the plurality of power combiners being coupled to the plurality of power amplifiers and to each other in a hierarchal corporate tree configuration, each of the first and second inputs of the lowest hierarchy of the plurality of power combiners being connected to the output of a respective power amplifier, each of the first and second inputs of each higher hierarchy of the plurality of power combiners being connected to the first output of a respective power combiner of a lower hierarchy of the plurality of power combiners;

a plurality of subarrays, each connected to the second output of the plurality of power combiners;

a plurality of antenna radiator elements for each subarray; and a second plurality of phase shifter elements, each connected to a radiator element of a respective subarray for controlling the phase of the signal entering the individual radiator element to steer the beam, the first plurality of phase shifter elements for controlling the phase of the signals entering corresponding power combiners of the hierarchal corporate tree to adjust the taper, power, and phase of the signals entering respective subarrays.

11. The antenna of claim 10 further comprising means for equalizing the power and phase of the microwave signal entering each subarray from a corresponding power combiner to provide uniform illumination.

12. The antenna of claim 11 wherein the means for varying the phase of the first phase shifter elements includes:

means for varying the phase of the signal entering a corresponding subarray from the plurality of power combiners having inputs directly connected to output of power amplifiers of the transmit modules for decreasing the power to the subarrays connected to the corresponding power combiners, and means for varying the phase of the power combiners connected farthest from the power amplifiers to increase the power of the microwave signal entering the corresponding subarrays.

13. The antenna of claim 11 wherein the means for varying the phase of the microwave signal entering each of the subarrays includes:

means for equalizing the phase of each of the microwave signals entering the subarrays, and means for varying the phase of selected ones of second phase shifter elements to match a spatial sidelobes of the signal entering the respective subarray.

* * * * *